US010752404B2

(12) United States Patent
Liang et al.

(10) Patent No.: US 10,752,404 B2
(45) Date of Patent: Aug. 25, 2020

(54) FOOD PACKING CUP

(71) Applicant: GUANGDONG PROVINCIAL BIOENGINEERING INSTITUTE (GUANGZHOU SUGARCANE INDUSTRY RESEARCH INSTITUTE), Guangdong (CN)

(72) Inventors: Lei Liang, Guangzhou (CN); Yuxing An, Guangzhou (CN); Jinrong Li, Guangzhou (CN); Jian Zeng, Guangzhou (CN); Weiwei Zhang, Guangzhou (CN); Qingfu Wang, Guangzhou (CN)

(73) Assignee: GUANGDONG PROVINCIAL BIOENGINEERING INSTITUTE (GUANGZHOU SUGARCANE INDUSTRY RESEARCH INSTITUTE), Guangzhou (CN)

( * ) Notice: Subject to any disclaimer, the term of this patent is extended or adjusted under 35 U.S.C. 154(b) by 0 days.

(21) Appl. No.: 16/159,091

(22) Filed: Oct. 12, 2018

(65) Prior Publication Data

US 2019/0055063 A1 Feb. 21, 2019

Related U.S. Application Data

(63) Continuation of application No. PCT/CN2017/111869, filed on Nov. 20, 2017.

(30) Foreign Application Priority Data

Jan. 10, 2017 (CN) ..... 2017 1 0018438

(51) Int. Cl.

| | |
|---|---|
| ***B65D 25/16*** | (2006.01) |
| ***B65D 85/80*** | (2006.01) |
| ***B65D 53/08*** | (2006.01) |

(52) U.S. Cl.

CPC ..... *B65D 25/16* (2013.01); *B65D 53/08* (2013.01); *B65D 85/80* (2013.01)

(58) Field of Classification Search

CPC ..... B65D 85/72; B65D 85/80; B65D 53/08

(Continued)

(56) References Cited

U.S. PATENT DOCUMENTS 5,201,459 A * 4/1993 Bettle, Jr. ..... B65D 5/70 215/388
2011/0036846 A1* 2/2011 Corbett ..... B65D 77/06 220/495.03

FOREIGN PATENT DOCUMENTS

CN 1246430 A 3/2000
CN 1853796 A 11/2006

(Continued)

OTHER PUBLICATIONS

International Search Report, dated Jan. 29, 2018, for corresponding international application PCT/CN2017/111869.

*Primary Examiner* — Jeffrey R Allen
(74) *Attorney, Agent, or Firm* — Myers Wolin, LLC

(57) ABSTRACT

A food packaging cup comprises a cup body, an inner film bag disposed in the cup body and a cup lid structure for sealing a cup mouth of the cup body. A bag mouth of the inner film bag is connected with the cup body by a detachable structure, a liquid receiving inner cavity is formed inside the inner film bag, the inner film bag can be separated from the inner wall of the cup body, and an air hole communicated with a gap between the inner film bag and the cup body is formed on the cup body. The food packaging cup is simple in structural production, low in cost, and convenient for various classes of consumers to further drink up thick fruit juice, milk, fermented milk, yoghourt and the like, (Continued)

thereby avoiding residues in the cup. Moreover, garbage of two different materials can be sorted clearly.

9 Claims, 2 Drawing Sheets

(58) Field of Classification Search
USPC ..... 220/495.04, 574.3, 495.03, 495.05
See application file for complete search history.

(56) References Cited

FOREIGN PATENT DOCUMENTS

| | | | |
|---|---|---|---|
| CN | 201849809 | U | 6/2011 |
| CN | 201914590 | U | 8/2011 |
| CN | 101208255 | A | 3/2013 |
| CN | 104097853 | A | 10/2014 |
| CN | 204660463 | U | 9/2015 |
| CN | 104960794 | A | 10/2015 |
| CN | 206494321 | U | 9/2017 |
| CN | 106586196 | A | 8/2018 |
| JP | H10245072 | A | 9/1998 |

* cited by examiner

FOOD PACKING CUP

CROSS REFERENCE TO RELATED APPLICATIONS

This application is a continuation under 35 U.S.C. § 120 of International Application PCT/CN2017/111869, filed Nov. 20, 2017, which claims priority to Chinese Application 201710018438.6, filed Jan. 10, 2017, the contents of each of which are incorporated by reference herein.

FIELD OF THE INVENTION

The disclosure relates to the technical field of food packaging, and particularly to a food packaging cup.

BACKGROUND

Straws are adopted for sucking in most of packaging cups for containing thick fruit juice, milk, fermented milk, yoghourt and the like. If a beverage is relatively thick, part of the beverage may be left on the inner wall of the cup and not suitable to drink up so as to cause unnecessary waste. Meanwhile, the residual beverage in the cup is easy to breed microorganisms so as to cause spoilage and influence environment sanitation. Moreover, the beverage packaging cup, due to material composition, is unclear in garbage classification, relatively high in processing cost of collection and recycling and insufficient in environmental protection. Therefore, it is valuable in market and significant in social to provide a packaging cup for thick liquid food, which allows drinking up easily and separating different materials easily.

SUMMARY

In order to solve the above-mentioned problem, the disclosure provides a food packaging cup convenient to package thick liquid beverages, which is simple in structural production, low in cost, and convenient for various classes of consumers to further drink up thick fruit juice, milk, fermented milk, yoghourt and the like, thereby avoiding residues in the cup and benefiting sanitation of the environment.

In the technical solution for solving the technical problem, a food packaging cup comprises a cup body, an inner film bag disposed in the cup body, and a cup lid structure for sealing a cup mouth of the cup body. A bag mouth of the inner film bag is connected with the cup body by a detachable structure. A liquid receiving inner cavity is formed inside the inner film bag. The inner film bag can be separated from the inner wall of the cup body. An air hole communicated with a gap between the inner film bag and the cup body is formed on the cup body.

Further, as the improvement of the technical solution of the disclosure, the bag mouth of the inner film bag is fixed to the edge of the cup mouth of the cup body by thermo-compression bonding.

Further, as the improvement for the technical solution of the disclosure, the detachable structure comprises a sawtooth line formed at the edge of the cup mouth of the cup body, and a circular ring strip which is easy to tear directionally and can enable the inner film bag to be separated from the cup body is formed by the sawtooth line.

Further, as the improvement for the technical solution of the disclosure, a tearable sticking film is disposed at the air hole outside the cup body.

Further, as the improvement for the technical solution of the disclosure, the sticking film is connected with the circular ring strip.

Further, as the improvement for the technical solution of the disclosure, the inner film bag is clung to the inner wall and a cup bottom of the cup body.

Further, as the improvement for the technical solution of the disclosure, the cup lid structure comprises a mouth sealing film.

Further, as the improvement for the technical solution of the disclosure, the food packaging cup further comprises a straw which can pierce the mouth sealing film to insert into the cup body.

Further, as the improvement for the technical solution of the disclosure, the cup body is a high polymer material cup or a cellulosic material cup.

The disclosure has the beneficial effect that: during using the food packaging cup, a thick liquid food is filled in the liquid receiving inner cavity of the inner film bag in the cup body; when sucking the thick liquid food by the straw inserted into the packaging cup, gas outside the cup body enters the gap between the inner film bag and the cup body through the air hole; the inner film bag is shrunk with that until being shrunk to have a zero space, then the inner film bag is easily separated from the cup body by the detachable structure; and a consumer can drink up the food by squeezing the inner film bag with hands, so that garbage of two different materials can be sorted simultaneously and clearly, and the processing cost of garbage collection and reusing is reduced. The food packaging cup is simple in structural production, low in cost, and convenient for various classes of consumers to further drink up thick fruit juice, milk, fermented milk, yoghourt and the like, thereby avoiding residues in the cup and benefiting sanitation of the environment.

BRIEF DESCRIPTION OF THE DRAWINGS

The disclosure will be further illustrated below with reference to the drawings, wherein.

DETAILED DESCRIPTION OF THE PREFERRED EMBODIMENTS

Figure 1:
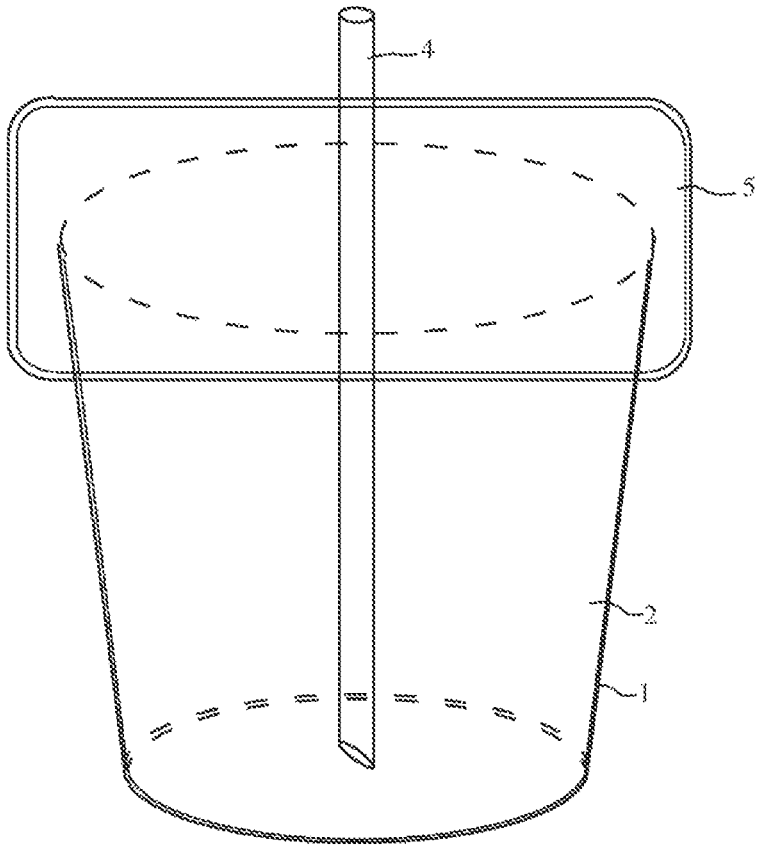
FIG. 1 is an overall structural schematic diagram according to the disclosure.
Figure 2:
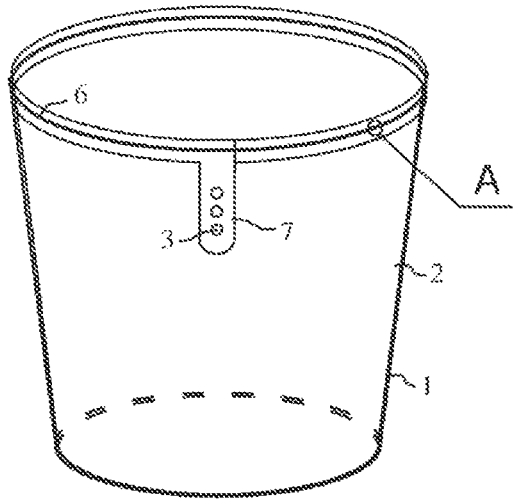
FIG. 2 is a schematic diagram of a detachable structure according to the disclosure.
Figure 3:
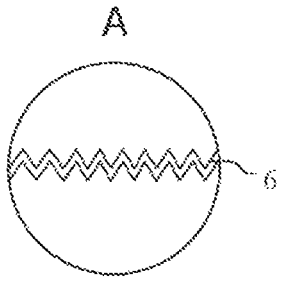
FIG. 3 is a partially enlarged view to the position A in FIG. 2.
Figure 4:
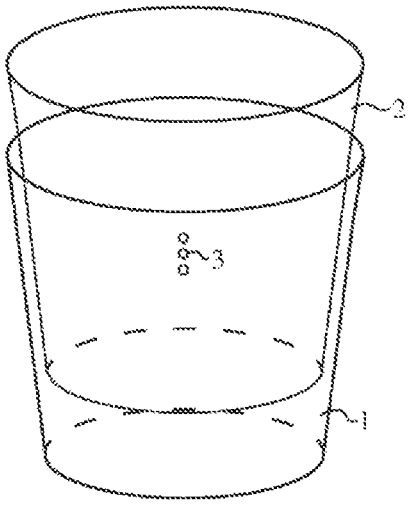
FIG. 4 is a structural schematic diagram of an inner film bag and a cup body, according to the disclosure.
Figure 5:
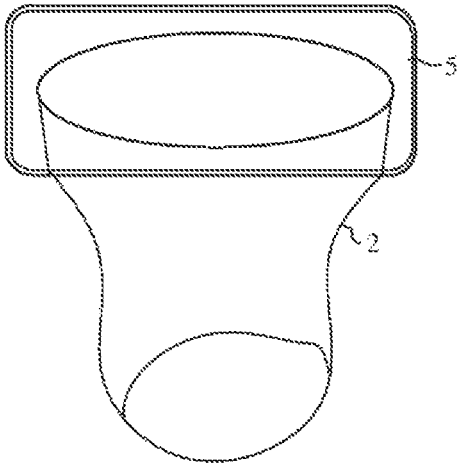
FIG. 5 is a schematic diagram of the taken out inner film bag, according to the disclosure.

With reference to FIG. 1 to FIG. 5, specific structures in the preferred embodiments of the disclosure are shown. Structural characteristics of each part of the disclosure will be illustrated in detail below, and if directions (up, down, left, right, front and back) are described, the structure as shown in FIG. 1 is taken as the reference description, but actual directions for the disclosure are not limited thereto.

The disclosure provides a food packaging cup, including a cup body 1, an inner film bag 2 disposed in the cup body 1 and a cup lid structure for sealing a cup mouth of the cup body 1. A bag mouth of the inner film bag 2 is connected with the cup body 1 by a detachable structure, a liquid receiving inner cavity is formed inside the inner film bag 2, the inner film bag 2 can be separated from the inner wall of the cup body 1, and an air hole 3 communicated with a gap between the inner film bag 2 and the cup body 1 is formed on the cup body 1.

The cup body 1 can be made of high polymer material or cellulosic material, having a shape of a cup, a cylinder, a square and the like. The inner film bag 2 is food-grade, ultrathin, shrinkable and difficult to pierce.

During using the food packaging cup, a thick liquid food is filled in the liquid receiving inner cavity of the inner film bag 2 in the cup body 1. When sucking the thick liquid food by a straw 4 inserted into the packaging cup, gas outside the cup body 1 enters the gap between the inner film bag 2 and the cup body 1 through the air hole 3, and the inner film bag 2 is shrunk with that until being shrunk to no space, then the inner film bag 2 is easily separated from the cup body 1 by the detachable structure. A consumer can drink up the food by squeezing the inner film bag 2 with hands, so that garbage of two different materials can be sorted simultaneously and clearly, and the processing cost of garbage collection and reusing is reduced. The food packaging cup is simple in structural production, low in cost, and convenient for various classes of consumers to further drink up thick fruit juice, milk, fermented milk, yoghourt and the like, thereby avoiding residues in the cup and benefiting sanitation of the environment.

In a preferred embodiment of the disclosure, the bag mouth of the inner film bag 2 is fixed to the edge of the cup mouth of the cup body 1 by thermocompression bonding. The inner film bag 2 is clung to the inner wall and a cup bottom of the cup body 1 so as to obtain the biggest liquid receiving inner cavity. The detachable structure comprises a sawtooth line formed at the edge of the cup mouth of the cup body 1, and a circular ring strip 6 which is easy to tear directionally and can enable the inner film bag 2 to be separated from the cup body 1 is formed by the sawtooth line. The circular ring strip 6 can enable the inner film bag 2 to be easily separated from the cup body 1, and the consumer can drink up the food by squeezing the inner film bag 2 with hands, so that garbage of two different materials can be sorted simultaneously and clearly, and the processing cost of garbage collection and reusing is reduced.

In order to avoid a case that the outside gas enters the cup body 1 through the air hole 3 before the food is sucked, a tearable sticking film 7 is disposed at the air hole outside the cup body. The sticking film 7 is connected with the circular ring strip 6, so that the sticking film 7 is firstly opened for being convenient for the plastic film inner bag to be shrunk when drinking.

The cup lid structure comprises a mouth sealing film 5. The food packaging cup further comprises the straw 4 which can pierce the mouth sealing film 5 to insert into the cup body 1. In the packaging process, the edge of the inner film bag 2 and the edge of the packaging cup are sealed and fixed, and then the packaging cup is covered with the mouth sealing film 5.

Certainly, the invention is not limited to the above-mentioned embodiments, those skilled in the art, under the teaching of the context of the disclosure, can further make equivalent deformations or replacements. Those equivalent deformations or replacements all shall fall within the scope defined by the claims.

What is claimed is:

1. A food packaging cup, comprising a cup body, an inner film bag disposed in the cup body, and a cup lid structure for sealing a cup mouth of the cup body, wherein:

a bag mouth of the inner film bag is connected with the cup body by a detachable structure, a liquid receiving inner cavity is formed inside the inner film bag for receiving liquid, the inner film bag clinging to an inner wall of the cup body, and an air hole communicated with an interior of the cup body is formed on the cup body, wherein when the liquid is sucked by a straw inserted into the packaging cup, air outside the cup body enters a gap between the inner film bag and the cup body through the air hole, causing the inner film bag to shrink with the volume of remaining liquid, and wherein after the inner film bag is shrunk, the inner film bag is separable from the cup body by the detachable structure.

2. The food packaging cup according to claim 1, wherein the bag mouth of the inner film bag is fixed to the edge of the cup mouth of the cup body by thermocompression bonding.

3. The food packaging cup according to claim 2, wherein the detachable structure comprises a sawtooth line formed at the edge of the cup mouth of the cup body, and a circular ring strip formed by the sawtooth line, which is directionally tearable, and enables the inner film bag to be separated from the cup body.

4. The food packaging cup according to claim 3, wherein a tearable sticking film is disposed at the air hole outside the cup body.

5. The food packaging cup according to claim 4, wherein the sticking film is connected with the circular ring strip.

6. The food packaging cup according to claim 2, wherein the inner film bag is clung to the inner wall and a cup bottom of the cup body.

7. The food packaging cup according to claim 1, wherein the cup lid structure comprises a mouth sealing film.

8. The food packaging cup according to claim 1, further comprising a straw able to pierce the mouth sealing film to insert into the cup body.

9. The food packaging cup according to claim 1, wherein the cup body is a high polymer material cup or a cellulosic material cup.

* * * * *